United States Patent [19]

Kondis

[11] 3,963,482

[45] June 15, 1976

[54] LARGE SIZE ALUMINUM PARTICLE CONTAINING ALUMINUM OXIDE THEREIN

[75] Inventor: Thomas J. Kondis, Pittsburgh, Pa.

[73] Assignee: Aluminum Company of America, Pittsburgh, Pa.

[22] Filed: May 5, 1975

[21] Appl. No.: 574,370

Related U.S. Application Data

[63] Continuation-in-part of Ser. No. 307,334, Nov. 17, 1972, Pat. No. 3,890,166.

[52] U.S. Cl. ..... 75/0.5 R; 148/6.27; 241/15; 241/16

[51] Int. Cl.[2] ..... B22F 9/00

[58] Field of Search ..... 75/.5 R, .5 AC, .5 BC, 75/213; 29/192 R, 192 CP; 241/15, 16; 148/6.27

[56] References Cited

UNITED STATES PATENTS

| | | | |
|---|---|---|---|
| 2,678,879 | 5/1954 | Nüesch et al. | 75/.5 R |
| 2,678,880 | 5/1954 | Nüesch et al. | 75/.5 R |
| 3,471,308 | 10/1969 | Clayton | 106/290 |
| 3,740,210 | 6/1973 | Bomford | 75/.5 AC |

*Primary Examiner*—W. Stallard
*Attorney, Agent, or Firm*—John P. Taylor

[57] ABSTRACT

Improved aluminum particulate suitable for powder metallurgy applications is produced by wet-milling particulate aluminum in an inert atmosphere in the presence of a predetermined amount of oxygen to thereby comminute the aluminum into finer particles while oxidizing the new surfaces of such particles and then, after the supply of oxygen is exhausted, welding together such particles by further milling to provide a larger aluminum particle having aluminum oxide dispersed therein.

3 Claims, 1 Drawing Figure

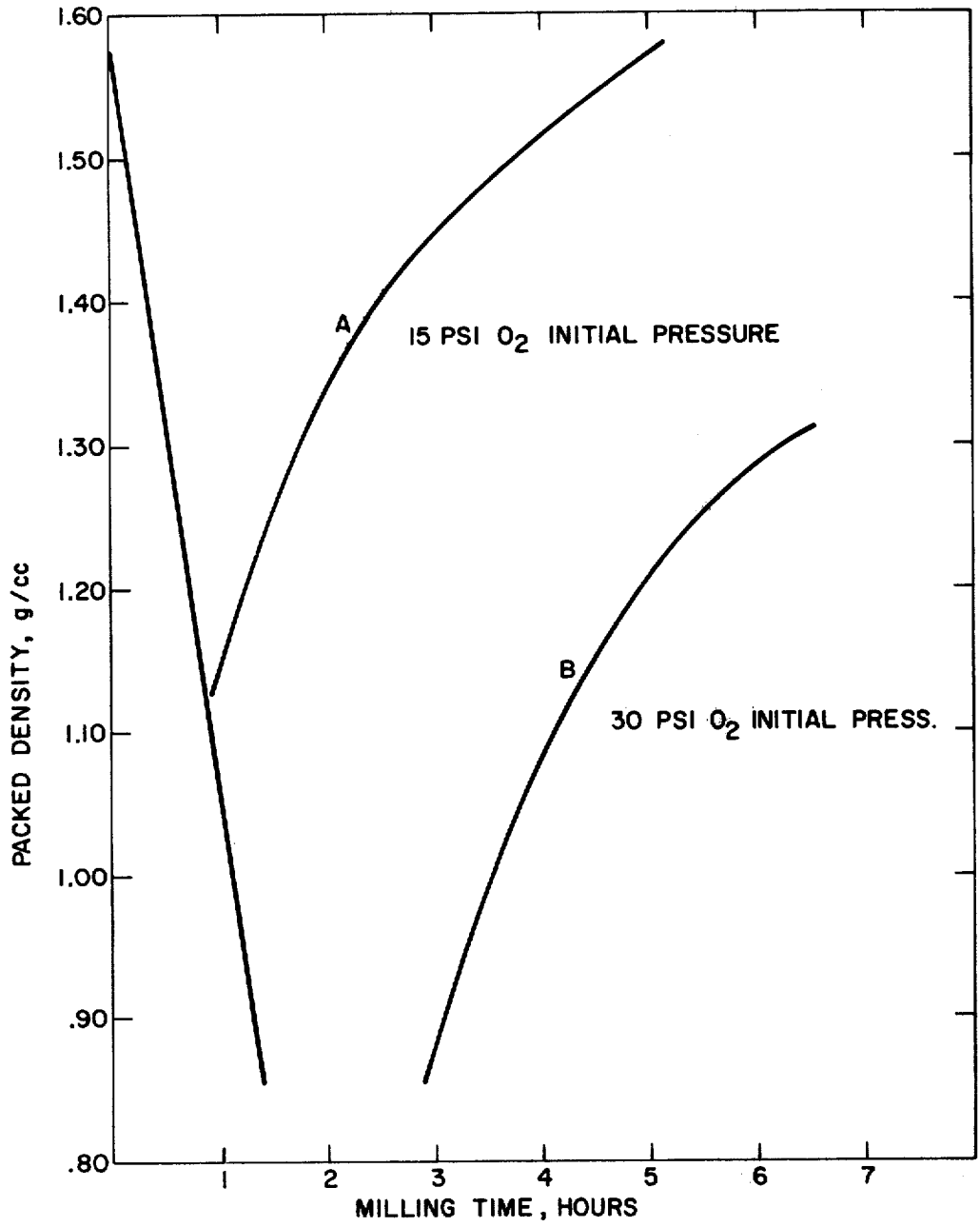
1.60
1.50
1.40
1.30
1.20
1.10
1.00
.90
.80
PACKED DENSITY, g/cc
A
15 PSI $O_2$ INITIAL PRESSURE
B
30 PSI $O_2$ INITIAL PRESS.
1
2
3
4
5
6
7
MILLING TIME, HOURS

LARGE SIZE ALUMINUM PARTICLE CONTAINING ALUMINUM OXIDE THEREIN

Cross-Reference to Related Application

This application is a continuation-in-part of my parent application Ser. No. 307,334, filed Nov. 17, 1972, now U.S. Pat. No. 3,890,166.

Background of the Invention

Particulate aluminum or aluminum powder, for example, atomized powder, is sometimes milled in an inert atmosphere in the presence of inert hydrocarbons such as hexane, kerosene, benzene, mineral spirits, or the like, to avoid excessive formation of an oxide-coated surface so that the aluminum surfaces thereby produced will combine under pressure with other materials such as, for example, hydrogen gas and olefins such as ethylene or isobutylene to form an alkylaluminum compound. Alternatively, the aluminum is milled under an oxidizing condition wherein the new surfaces of particles are immediately oxidized as they are formed to prevent explosions of subsequently dried powders or fires initiated by inadvertent exposure of unoxidized masses of aluminum to the atmosphere. For example, Kondis et al. U.S. Pat. No. 3,781,177, assigned to the assignee of this invention, deals with the addition of isostearic acid to such oxidized aluminum particles to render such particles non-dusting.

My parent application was directed to yet a third way of milling aluminum particles in which the particles are not oxidized but are formed in contact with a milling aid which will sorb onto the freshly created surfaces to thereby provide a pyrophoric particulate aluminum product, preserving the reactivity of the particulate aluminum which, of course, is lost if the particles are immediately oxidized.

It was, however, pointed out in that application that an additional reason why grinding under a completely inert atmosphere was unsuccessful — in the absence of the milling aids described and clained in my parent application — was that the comminuted particles tended to reweld together again, the purpose of the milling aid being to prevent this tendency to reweld. It was further pointed out that milling time was significant in the practice of the invention of my parent application only insofar as the milling did not continue beyond the time required to generate enough new surfaces to sorb all the milling aid available in the mill since complete utilization of the milling aid would cause the active milling environment to revert to an inactive environment wherein the prior art problem of welding would again begin to predominate.

In the production of powder metallurgy parts, it has been found that a superior product will be formed if the aluminum powder contains some minor amounts of aluminum oxide as well, and especially so if the aluminum oxide is uniformly distributed throughout the subsequent compact. I have discovered that I can produce such a particle by carefully controlling the milling conditions so that I respectively first provide conditions wherein comminution will prevail and then permit the mill to revert to conditions wherein welding will prevail.

Summary of the Invention

In accordance with the invention, an aluminum particulate is produced suitable for powder metallurgy applications by first milling particulate aluminum in an inert liquid and in the presence of a predetermined amount of oxygen thereby comminuting the aluminum into finer particles while oxidizing the new surfaces of such finer particles and then welding the fine oxidized particles together after the supply of oxygen is exhausted thereby providing a larger aluminum particle having minor amounts of aluminum oxide dispersed therein. In an alternate embodiment, the aluminum is first milled in accordance with the invention claimed in my parent application, then oxidized, and finally milled under conditions promoting welding.

Brief Description of the Drawing

The sole drawing of the invention is a graph showing control of the milling conditions in the practice of the invention.

Description of the Invention

In accordance with the invention, I produce a particulate aluminum having minor amounts of aluminum oxide therein which is suitable for powder metallurgy uses by the control of the conditions within a mill to respectively first provide comminution and then subsequently provide welding conditions.

In accordance with my invention, the milling is carried out in the presence of an inert liquid which preferably is a hydrocarbon such as benzene, toluene, xylene, kerosene, hexane, octane, mineral spirits, cyclohexane, or the like. The choice of inert liquids influences the shape of the particle. As described and claimed in my copending application entitled "Large Particle Size Aluminum Pigments Produced by Working and Welding Smaller Particles" filed concurrently with this application, milling inert aliphatic liquids results in the production of platelet-like particles while milling in an inert aromatic liquid results in formation of a granular-shaped particle.

A further ingredient which will inhibit the rewelding together of the pyrophoric surfaces of the aluminum as they are produced is also used. Preferably, this ingredient comprises a measured amount of oxygen. Such additional agent may, alternatively, be any one of the milling aids described and claimed in my parent application. If a milling aid is used, pyrophoric or nascent aluminum surfaces will be produced which must be then subsequently oxidized with a controlled amount of oxygen to provide the desired aluminum oxide surfaces. In the case of the direct use of oxygen, these surfaces will be produced in situ as the milling continues.

In either event, the second stage of the milling comprises further milling the aluminum oxide surfaces in the absence of further amounts of oxygen or milling aid to thereby promote welding conditions wherein the freshly generated nascent or pyrophoric aluminum surfaces generated upon such further milling will react with one another to cause rewelding together of the particles. Such rewelding actually results in a conglomerate type particle which is actually the product of many smaller particles which still contain minor amounts of aluminum oxide from the first stage milling since subsequent milling only fractures a part of the previously oxidized surface resulting in production of nascent aluminum surfaces at that point, while the remaining surface of the particle still is oxidized. Thus, the final product has large amounts of aluminum oxide from the surfaces of the tiny particles incorporated into the larger conglomerate particle.

Such conglomerate particles are desirable from two points of view. First, each particle itself contains aluminum oxide in its interior regions, relatively uniformly dispersed, the degree of dispersion and quantity of oxide being functions of the amount of comminution obtained during the first stage of milling and subsequent particle size distribution of the comminuted particles. This ensures uniform distribution of oxide throughout cold compacts subsequently compressed from the product powder. Second, the comminuted powder from the first stage of milling is predominantly of a size that passes through a standard 325 mesh U.S. Sieve. Typically, such comminuted particles fall into a general range of about 1 to 25 micrometers, as measured by an electrical resistance method using a Coulter Counter (Coulter Electronics, Inc., 590 West 20th St., Hialeah, Fl.). Such particles are extremely dusty and dangerous to handle, constituting an explosive hazard. The further milling under conditions to promote particle rewelding eliminates these 1 to 25 micrometer fines and produce a granular product which substantially does not pass through a 325 mesh U.S. Sieve, significantly reducing the hazards in handling and further contributing to cleanliness of the work area surrounding the compacting press.

In accordance with the invention, the initial particle size of the aluminum particles may vary widely from about 5 mm to several micrometers. Initial milling is for a period of time sufficient to provide the desired oxidized surfaces on the aluminum. For example, referring now to the drawing, the oxidization of the particles can be monitored by periodic measurement of the packed density in grams per cubic centimeter of the aluminum particles. As can be seen from the drawing, as the milling proceeds and the oxygen is used up, the packed density begins to drop (due to the greater bulkiness of the oxidized aluminum particle). Eventually, however, as the oxygen initially charged to the mill is depleted, the packed density again begins to rise as welding of the particles commences. As shown in curve A wherein 15 pounds/sq. in. of oxygen were initially charged to the mill, the bulk or packed density will rise almost as high as the initial density of the material prior to commencement of the milling. When 30 pounds/sq. in. oxygen is used, the initial milling condition will of course continue for a longer period of time since there is more oxygen to be used up. As a result, a longer period of milling under welding conditions is required before the welded particle has as large a density as the initial particle as illustrated by curve B in the drawing.

Other monitoring methods can of course be used such as monitoring the pyrophoricity of the aluminum, monitoring the surface area, monitoring the amount of oxygen or milling aid remaining, or using a time measurement based on previous runs under similar conditions.

To further illustrate the invention, a 50 gram charge of No. 120 atomized aluminum powder was milled in a 1 liter capacity mill. Typical particle size distribution of Alcoa grade 120 atomized powder is as follows:

| | |
|---|---|
| 40 mesh, U.S. Sieve | 100% passes through |
| 100 mesh, U.S. Sieve | 80% passes through |
| 200 mesh, U.S. Sieve | 55% passes through |
| 325 mesh, U.S. Sieve | 35% passes through |

Benzene was chosen as the inert liquid. Two runs were made. The first run was made under 1 atmosphere of oxygen (about 15 psi) and the second at about 2 atmospheres (about 30 psi). In this instance, the conditions in the mill were monitored using measurement of the partial pressure to indicate the depletion of the oxygen. For the run milled with one atmosphere of oxygen, partial vacuum was developed in the mill at 1 hour and full vacuum at 2 hours indicating that welding conditions were then predominant. For the run milled with 2 atmospheres of oxygen, partial vacuum was developed at 3 hours and full vacuum at 5 hours.

The powders produced during these runs were then digested in caustic solution and the volume of hydrogen gas measured to determine the amount of metallic aluminum (as opposed to aluminum oxide). The results indicated that when one atmosphere of oxygen was used the particles eventually reached a constant metallic content of about 95½% aluminum by weight whereas the particles initially milled under 2 atmospheres of oxygen eventually reached a constant metal content of about 90½% by weight, thus indicating a greater amount of aluminum oxide present in this batch.

Having thus described my invention, what is claimed is:

1. A method of producing improved aluminum particulate suitable for powder metallurgy applications comprising:

a. milling particulate aluminum in an inert liquid and in the presence of a predetermined amount of oxygen thereby comminuting the aluminum into finer particles while oxidizing the new surfaces of such finer particles; and b. further milling said oxidized aluminum particles after the supply of oxygen is exhausted to cause the particles to weld together thereby forming an aluminum particle having aluminum oxide dispersed therein.

2. The method of claim 1 wherein said inert liquid is selected from the class consisting of inert aromatic liquids and inert aliphatic liquids.

3. A method of producing improved aluminum particulate having aluminum oxide uniformly distributed therein which comprises:

a. milling particulate aluminum in an inert liquid in the presence of a milling aid capable of sorbing onto the surface of the aluminum sufficiently to prevent welding of the particles, said milling aid being selected from the class consisting of oxygen-containing compounds, olefins, hydrocarbon free radicals, hydrazine free radicals and chlorinated hydrocarbons;

b. oxidizing said pyrophoric aluminum surfaces; and c. further milling said oxidized aluminum particles in the absence of an oxidizing atmosphere to cause the particles to weld together thereby forming an aluminum particle having aluminum oxide dispersed therein.

* * * * *